US006474336B1

(12) United States Patent
Wolfe

(10) Patent No.: US 6,474,336 B1
(45) Date of Patent: Nov. 5, 2002

(54) MINI PLEATED FACE MASK

(76) Inventor: Michael Wolfe, 101 W. 90th St., New York, NY (US) 10024

( * ) Notice: Subject to any disclaimer, the term of this patent is extended or adjusted under 35 U.S.C. 154(b) by 0 days.

(21) Appl. No.: 09/531,852

(22) Filed: Mar. 20, 2000

(51) Int. Cl.[7] ..... A62B 18/02

(52) U.S. Cl. ..... 128/206.21; 128/206.19; 128/206.12

(58) Field of Search ..... 128/206.21, 206.19, 128/206.12, 205.27; D29/8

(56) References Cited

U.S. PATENT DOCUMENTS

| | | | | | |
|---|---|---|---|---|---|
| 715,052 | A | | 12/1902 | Goodwin | |
| 2,458,580 | A | | 1/1949 | Fisketti et al. | |
| 2,494,406 | A | | 1/1950 | Reitano | |
| 2,565,124 | A | | 8/1951 | Durborow | |
| 2,751,905 | A | | 6/1956 | Creelman | |
| 2,752,916 | A | * | 7/1956 | Haliczer | 128/206.19 |
| RE24,549 | E | * | 10/1958 | Haliczer | 128/206.19 |
| 3,170,461 | A | | 2/1965 | Watts | |
| 3,603,315 | A | | 9/1971 | Becker | |
| 3,613,678 | A | | 10/1971 | Mayhew | |
| 3,664,335 | A | | 5/1972 | Boucher | |
| 3,802,429 | A | | 4/1974 | Bird | |
| 3,884,227 | A | * | 5/1975 | Lutz et al. | 128/206.19 |
| 3,960,096 | A | * | 6/1976 | Zobel | 112/121.11 |
| 3,985,132 | A | * | 10/1976 | Boyce et al. | 128/206.19 |
| 4,014,047 | A | * | 3/1977 | Zobel | 2/206 |
| 4,248,220 | A | | 2/1981 | White | |
| 4,300,549 | A | | 11/1981 | Parker | |
| 4,377,431 | A | * | 3/1983 | Chodosh | 156/204 |
| 4,606,341 | A | * | 8/1986 | Hubbard et al. | 128/206.19 |
| 4,685,944 | A | * | 8/1987 | Allan et al. | 55/491 |
| 4,688,566 | A | * | 8/1987 | Boyce | 128/206.19 |
| 4,739,755 | A | * | 4/1988 | White et al. | 128/206.12 |
| 4,802,473 | A | | 2/1989 | Hubbard et al. | |
| 5,290,331 | A | * | 3/1994 | Miles et al. | 55/321 |
| 5,561,863 | A | * | 10/1996 | Carlson, II | 2/206 |
| 5,699,792 | A | * | 12/1997 | Reese et al. | 128/206.19 |
| 5,701,892 | A | * | 12/1997 | Bledstein | 128/206.19 |
| 5,701,893 | A | | 12/1997 | Kern et al. | |
| 5,813,398 | A | | 9/1998 | Baird et al. | |
| 6,027,553 | A | * | 2/2000 | Hirano et al. | 95/283 |
| 6,261,979 | B1 | * | 7/2001 | Tanaka et al. | 442/370 |
| 6,289,974 | B1 | * | 9/2001 | DeGregoria et al. | 165/8 |
| 6,354,296 | B1 | * | 3/2002 | Baumann et al. | 128/206.19 |

FOREIGN PATENT DOCUMENTS

| | | |
|---|---|---|
| DE | 1195603 | 6/1965 |
| GB | 892262 | 3/1962 |
| GB | 871661 | 5/1973 |

* cited by examiner

*Primary Examiner*—John G. Weiss
*Assistant Examiner*—Joseph F. Weiss

(57) ABSTRACT

A face mask comprising mini pleats which are sized and configured to create a standing seam, that structurally forms a breathing chamber when the face mask is placed upon a user's face.

20 Claims, 3 Drawing Sheets

(1 of 3 Drawing Sheet(s) Filed in Color)

MINI PLEATED FACE MASK

BACKGROUND OF THE INVENTION

This invention relates to face masks, and more particularly to face masks where the mask material is mini pleated, which when worn, structurally creates a breathing chamber in front of the wearer's mouth.

Face masks are found in use as general use masks to protect the wearer from respiratory harm created by dust, dirt, pollen and work place generated particles. They are also found, as in surgical use, to protect against the transmission of bacteria both to and from the wearer.

Among these, there are presently masks which are constructed with horizontal pleats. These pleats being either back and forth folds or in combination with reverse folds in the filtering material. The pleating of these masks however is for the purpose of vertical increase adjustment, to fit on to the wearer's face from being packaged flat for shipping and storing. These pleats are generally folds of more than ½ inch which are not of the character necessary to also structurally form a breathing chamber. Masks employing these pleats of the prior art, without additional supports built into the mask in front of the mouth, normally collapses upon the mouth of the wearer.

Other masks have been made with air spaces or chambers constructed in front of the mouth, employing a frame, structural webbing, ribs, seams, or other structural supports in order that the mask material does not collapse on the wearer's mouth. These masks, which employ these additional supports are more complicated and expensive to fabricate and many are not at all attractive. Some masks even attach an appendage to form a chamber, but these too add complication to the construction of the mask.

SUMMARY OF THE INVENTION

The present invention is an improvement in face masks for covering the wearer's mouth, nose or both. This mask utilizes materials and methods which, when mini pleated, structurally creates a breathing chamber in front of the mouth as well as providing for improved flexibility with facial jaw movement. Within the scope of this invention, the term "folded" is the same and interchangeable as "pleated". Pleating being defined as a form of folding. This mask is basically flat and compact in shape when manufactured, but because of its mini pleated structure forms a three dimensional breathing chamber when adorned without additional seams or ribs and maintains a chamber shape with facial movement. It is found that by employing mini pleated ribs, generally from 1/16" to 5/8" but more particularly about 1/8" in the mask material, that a natural standing seam is formed down the center of the mask due to the convergence of these pleats, as it is folds across the wearers face, or is activated merely by stretching apart the top and bottom of the mask. A standing seam is herein defined as an upward or outward projection such as depicted in 4 of FIG. 1. Convergence is defined as the cross interaction between the pleated ribs or folds when the mask is actuated or worn as in FIGS. 6, 7, 8, 9. An example of this support convergence is a folded plate roof in building construction where the roof is supported by the interaction of the different planes of surfaces. A chamber is formed in front of the mouth due to the interaction of these ribs from both sides of the mask, creating a standing seam which is in effect a supporting seam in the front of the mask without the employment of the like as sewn seams, ribs, or supporting frames.

Mini pleats may be created by different methods, for example by stitch pleating (by sewing machine), heat set pleating, or other methods which may be employed in order obtain such a configuration, including folding. In the pleating arts, a generally 1/16" pleat is known as a #2 pleat (2/32") a generally 3/32" pleat is known as a #3 pleat (3/32"). The term generally is used in that when a "#3" pleat is set on say a pleating machine, many factors determine the increase or decrease in the size of the resulting pleat. A #1 pleat (1/32") is generally considered the smallest pleat with pleats greater than 12" known. A pleat in the area of ¾" would be considered a small pleat to a person in the pleating arts and a mini pleat would be considered among the smallest pleats from ½" down to the #1 or 1/32" pleat or to the smallest pleat obtainable.

Different mask materials may be employed with differences in pleating size and technique used to suit the various individual materials, laminations or combinations of materials. For instance, polyester is one material which is not only readily adaptable to heat set pleating, but maintains the set pleat very well. Synthetics like polyester or nylon either woven or non woven may be used as well as natural fibers such as cotton, silk or tissue. There is also a form of pleating called "crystal" or "accordion" pleating where instead of each pleat being folded and lying flat against the previous pleat, such as in a "flat" or "side" pleat as in FIG. 4. the pleat stands up, or is "open" like an accordion fold as in FIG. 3. A mask employing this type of mini pleats would be excellent for creating the present invention. There are also "box" pleats which reverse-at every other pleat and combination pleats which employ different types of pleats in different combinations. These or additional forms of pleats, may be used in the present invention.

Masks configured with mini pleats could be employed in permanent all purpose dust, allergy and work masks, as well as medical type disposables or non-disposables. Permanent type polyester masks would be capable of withstanding general washing for general use, as well as chemical antibacterial rinse for medical use. Although the common type of mask for medical use are the disposables, permanent types could very well be used in field situations. Mini pleated masks of non woven synthetic melt blown fiber or paper type natural fiber could be used for disposable medical type masks.

The present invention, in creating this chamber in front of the mouth, prevents the mask material from collapsing on the mouth as in present pleated masks. It is, thus, easier to breathe and more pleasant to use the mask. Another benefit of this invention is that the chamber is formed without employing supporting framework or additional seaming and, as such, is simpler and more economical to manufacturer as well as eliminating unsightly ribs and seams. Another benefit of mini pleating is that a wider surface area of the filter material away from the mouth creates increased surface area in the chamber, increasing air flow through the material, as well as a reservoir space inside the mask for easier breathing and higher possible respiration air flow rates. The mini pleating itself also increases surface area of the filter material so also increases air flow through the filter.

The mini pleat mask easily expands and contracts, like an accordion, with the wearer's facial movement, better than masks presently in use. Pleated face masks presently in use employ pleats in order to expand to fit the wearers face but does little to flex with the facial movement and sits flat against the face of the wearer.

The present invention can be employed in the many types of masks currently in use. It can be employed in surgical non woven disposables as well as woven all purpose permanent dust and allergy masks. Because this invention not only results in a better utilitarian product and a more attractive mask, it could be more widely accepted. The present invention would also be beneficial for industrial and construction use, where there is a high concentration of dust, for example in sanding joint compound material in gypsum wall board work. A mini pleated woven polyester mask would also decrease the amount of expired moisture build up, dampness, and sweating. This mini pleated mask is more comfortable to wear than the rigid shell masks presently in use and easier to breathe through. The main object of this invention is an improvement in face masks which are simpler in form, construction and manufacture yet is more utilitarian, esthetic, flexible and easier to breathe through.

DETAILED DESCRIPTION OF THE DRAWINGS

Figure 1:
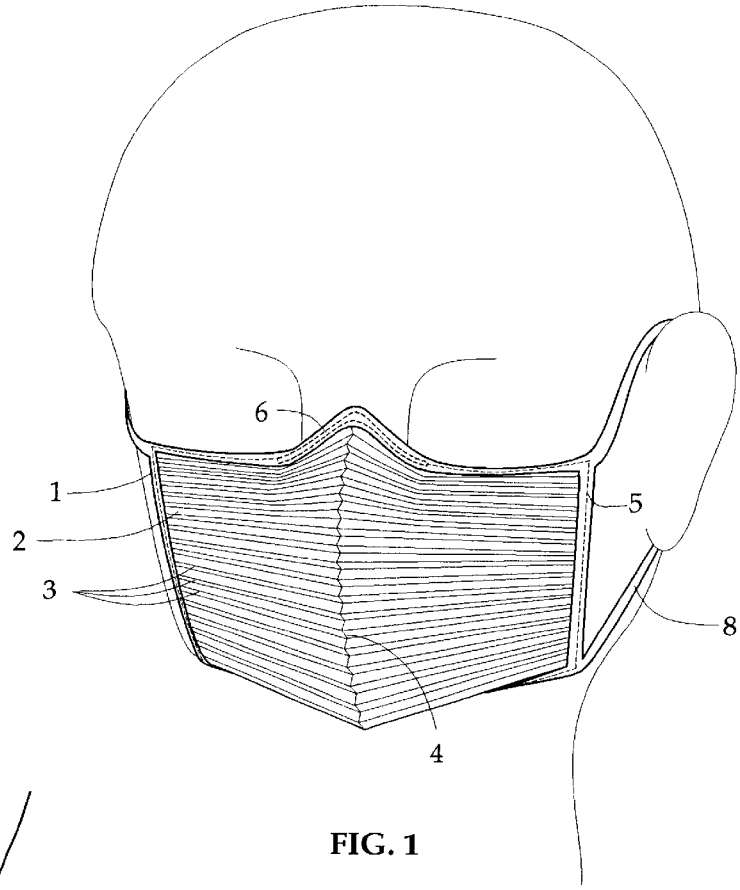
FIG. 1 is a perspective view of the face mask of the present invention showing the mini ribbed material, and the seam formed when applied to the wearer's face.
Figure 2:
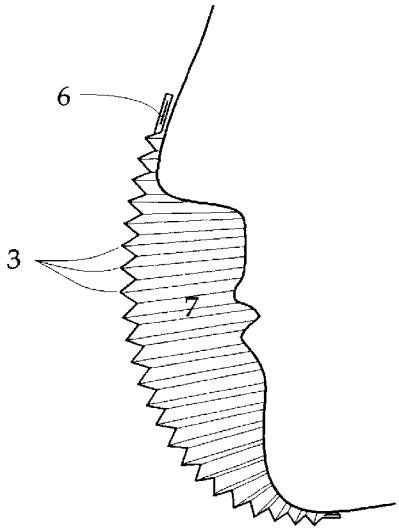
FIG. 2 is a cross section through the pleated mask showing the pleating and breathing chamber created by the structural ridge formed by the mini pleats.
Figure 3:
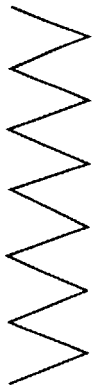
FIG. 3 is a cross section diagram of an open "crystal" or "accordion" pleat.
Figure 4:
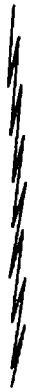
FIG. 4 is a cross section diagram of an "flat" or "side" pleat.
Figure 5:
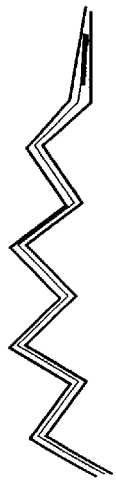
FIG. 5 is a partial cross section detail of multiple layers of pleated material.
Figure 6:
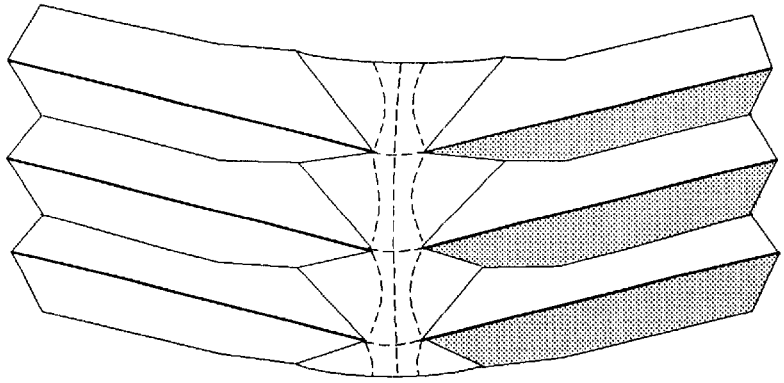
FIG. 6 is a detail of pleats in simple convergence.
Figure 7:
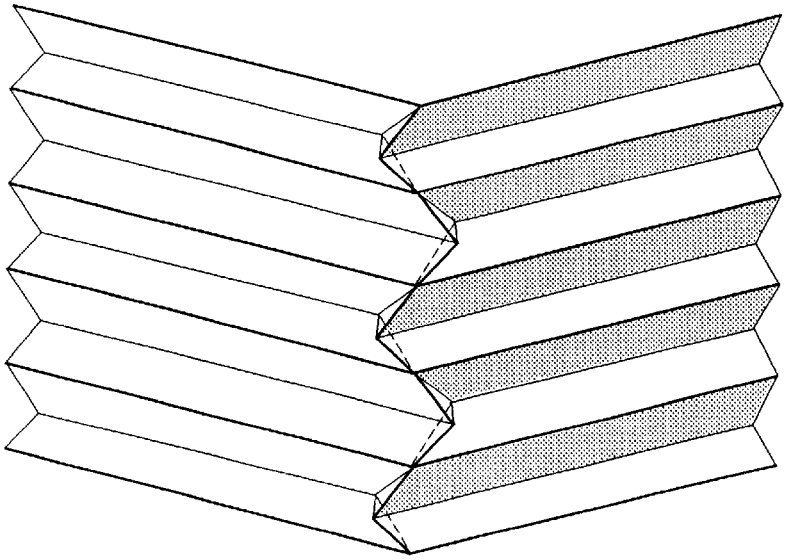
FIG. 7 is a detail of pleats in complex convergence.
Figure 8:
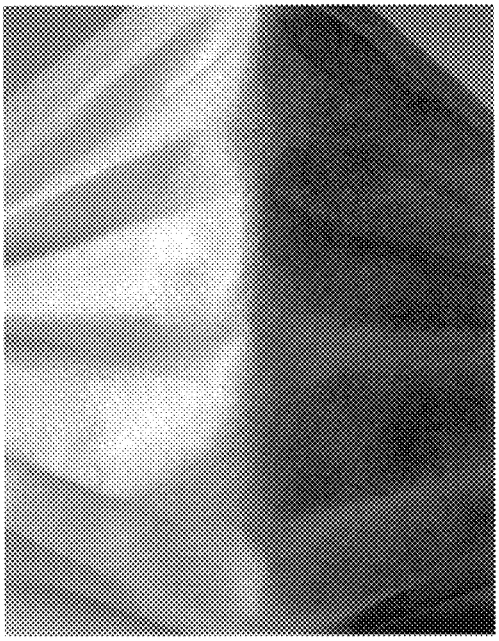
FIG. 8 is a photograph depicting simple convergence.
Figure 9:
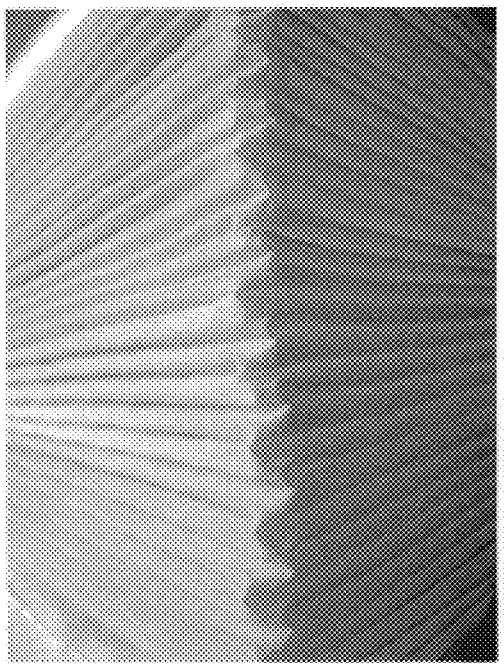
FIG. 9 is a photograph depicting complex convergence.

Mask 1 is shown with filter material 2 in which mini pleats 3 have been formed by any of several pleating methods. The pleats, in the present embodiment, are made horizontal, essentially but not necessarily parallel. Before the mask is put on by the wearer the material lays essentially in a flat and compact condition. When the mask is activated or applied or adorned to the face, the mini pleated material upon activation or folding across the wearer's face, forms a center ridge 4 due to the convergence of the opposing (from both sides of the mask) mini pleats, structurally creating a breathing chamber 7 in front of the wearer's mouth. Masks on the present market have about 3 to 5 pleats from ¾" and larger, are for vertical expansion and display no convergence. When the pleats get smaller and are generally ⅝" or smaller, there is, (depending on material and process) a simple convergence as in drawing detail FIG. 6 and depicted in FIG. 8. When the pleats get smaller still as in mini pleats (depending on material and process) down to about 1/16" range, there can be a more complex convergence as in drawing detail FIG. 7 and depicted in FIG. 9. The structural ridge 4 keeps the material from collapsing, on inhalation, upon the wearer's mouth, makes it easier to breathe and talk with the mask on, avoids coming in contact with makeup such as lipstick, and is more comfortable to wear. A trimming 5 may be employed preferably but not necessarily elastic on one or more of the edges of the mask. One or more of the mask's edges may be self trimmed by the filter material itself. The mask material, its trimming, if employed, and head attachments maybe bonded together by one or more of several bonding methods including stitching, heat and/or pressure bonding, gluing, ultraviolet or ultrasonic bonding. A deformable "nose bridge" strip 6 usually of a pliable metal, which when adjusted over the contour of the nose seals the mask against the face to prevent air leakage at the indentation at the sides of the wearer's nose. Ear loop bands 8 of elastic material are an example of the many possible forms of attachment to hold the mask upon the wearer's face. The filter material in the present invention may be composed of a single layer or multiple layers as in FIG. 5, and may be comprised of similar materials or of different layers of material.

Various changes, additions, different combinations and modifications may be made to the present invention without departing from its spirit and scope. Such changes, additions and modifications within a fair reading of the appending claims are intended as part of the present disclosure.

I claim:

1. A face mask comprising mini pleats which are sized and configured to create a standing seam, that structurally forms a breathing chamber when the face mask is placed upon a user's face.

2. A face mask according to claim 1 wherein the mini pleats are formed from at least one layer of filtering material.

3. A face mask according to claim 1 wherein multiple layers of different materials are employed.

4. A face mask according to claim 1 wherein the mini pleats are sized greater than 1/32" but less than ½".

5. A face mask according to claim 1 wherein the mask is crystal pleated.

6. A face mask according to claim 1 wherein the mask is flat pleated.

7. A face mask according to claim 1 wherein the the mask is formed using woven material.

8. A face mask according to claim 1 wherein the mask is formed using non-woven material.

9. A face mask comprising mini pleats.

10. A face mask according to claim 9 wherein the mini pleats are formed from at least one layer of filtering material.

11. A face mask according to claim 9 wherein multiple layers of different materials are employed.

12. A face mask according to claim 9 wherein the mini pleats are sized greater than 1/32" but less than ½".

13. A face mask according to claim 9 wherein the mask is crystal pleated.

14. A face mask constructed with mini pleats which are configured and sized, which upon activation creates a convergence of the pleats and a standing seam, which facilitates chamber formation.

15. A face mask according to claim 14 wherein the mini pleats are formed from at least one layer of filtering material.

16. A face mask according to claim 14 wherein multiple layers of different materials are employed.

17. A face mask according to claim 14 wherein the mini pleats are sized greater than 1/32" but less than ½".

18. A face mask according to claim 14 wherein the mask is crystal pleated.

19. The method of constructing a face mask with mini pleats such that the mini pleats, upon convergence in folding upon application to the wearer's face, creates a standing seam, which structurally forms a breathing chamber in front of the wearer's mouth.

20. The method of using a face mask with mini pleats such that the mini pleats, upon activation creates a convergence of the pleats and a standing seam, which facilitates chamber formation.

* * * * *

UNITED STATES PATENT AND TRADEMARK OFFICE

CERTIFICATE OF CORRECTION

PATENT NO. : 6,474,336 B1
DATED : November 5, 2002
INVENTOR(S) : Michael Wolfe

It is certified that error appears in the above-identified patent and that said Letters Patent is hereby corrected as shown below:

Title page,
Item [76], should read:
-- Michael Wolfe,
377 Rector Place,
New York, NY (US) 10280 --

Signed and Sealed this

Eighteenth Day of February, 2003

JAMES E. ROGAN
*Director of the United States Patent and Trademark Office*